US005171200A

United States Patent [19]

Jones

[11] Patent Number: 5,171,200

[45] Date of Patent: Dec. 15, 1992

[54] METHOD AND APPARATUS FOR EXERCISING THE LUMBAR MUSCLES

[76] Inventor: Arthur A. Jones, 1155 NE. 77th St., Ocala, Fla. 32670

[21] Appl. No.: 666,219

[22] Filed: Mar. 7, 1991

Related U.S. Application Data

[60] Continuation-in-part of Ser. No. 422,905, Oct. 18, 1989, Pat. No. 5,005,830, which is a division of Ser. No. 236,367, Aug. 25, 1988, Pat. No. 4,902,009, which is a continuation-in-part of Ser. No. 60,679, Jun. 11, 1987, Pat. No. 4,836,536, and a continuation-in-part of Ser. No. 181,372, Apr. 14, 1988, Pat. No. 4,834,365, said Ser. No. 666,219, Continuation-in-part of Ser. No. 637,618, Continuation-in-part of Ser. No. 361,055.

[51] Int. Cl.[5] ..... A63B 21/00

[52] U.S. Cl. ..... 482/134; 482/100; 482/136; 482/142

[58] Field of Search ..... 272/117, 118, 125, 134, 272/143, 144; 482/94, 97, 98, 99, 100, 101, 102, 103, 133, 134, 135, 136, 137, 142

[56] References Cited

U.S. PATENT DOCUMENTS

| | | | |
|---|---|---|---|
| 4,296,924 | 10/1981 | Anzaldua et al. | 272/117 |
| 4,462,252 | 7/1984 | Smidt et al. | 272/134 X |
| 4,500,089 | 2/1985 | Jones | 272/117 |
| 4,666,149 | 5/1987 | Olschansky et al. | 272/134 X |
| 4,678,186 | 7/1987 | McIntyre et al. | 272/134 |
| 4,711,448 | 12/1987 | Minkow et al. | 272/118 X |
| 4,725,056 | 2/1988 | Rehrl et al. | 272/134 |
| 4,732,381 | 3/1988 | Skowronski | 272/134 |
| 4,836,536 | 6/1989 | Jones | 272/134 |
| 4,902,009 | 2/1990 | Jones | 272/134 |

FOREIGN PATENT DOCUMENTS

| | | | |
|---|---|---|---|
| 121902 | 10/1984 | European Pat. Off. | 272/134 |

OTHER PUBLICATIONS

Nautilus Sports/Medical Industries Brochure, pp. 8 and 21.

*Primary Examiner*—Robert Bahr
*Attorney, Agent, or Firm*—William E. Mouzavires

[57] ABSTRACT

Method and apparatus for exercising the lumbar muscles including a movement arm which is moved about either a vertical or a horizontal axis depending on how a support for the movement arm is oriented relative to a primary support. In one position of the support the movement arm is moveable about a horizontal axis with the person seated in a generally upright position while in another position of the support, the movement arm is moveable about a generally vertical axis with the person positioned on his/her side. During exercise, the position of the persons head is fixed relative to the movement arm, and the pelvis is also fixed against movement.

17 Claims, 5 Drawing Sheets

METHOD AND APPARATUS FOR EXERCISING THE LUMBAR MUSCLES

RELATED APPLICATIONS

This application is a continuation in part of my co-pending U.S. application Ser. No. 07/422,905 filed Oct. 18, 1989 and entitled Machine for Exercising and/or Testing Muscles of the Lower Trunk, and Method now U.S. Pat. No. 5,005,830, which is a division of my application Ser. No. 07/236,367 filed Aug. 25, 1988 and now U.S. Pat. No. 4,902,009 which in turn is a continuation in part of my application 07/060,679 filed Jun. 11, 1987 now U.S. Pat. 4,836,536 as well as a continuation in part of my application 07/181,372 filed Apr. 14, 1988 now U.S. Pat. No. 4,834,365. The present application is also a continuation in part of my co-pending U.S. application Ser. No. 07/637,618 filed Jan. 4, 1991, now U.S. Pat. No. 5,092,590, which is a division of my application Ser. No. 07/422,905 filed Oct. 18, 1989 and identified above. The present application is also a continuation in part of my copending application Ser. No. 07/361,055 filed Jun. 5, 1989, now U.S. Pat. No. 5,007,634. Each of the foregoing applications and patents is hereby incorporated by reference into the disclosure of the subject application.

BACKGROUND OF INVENTION

The present invention relates to methods and apparatus for exercising and/or testing the lumbar muscles of the human body. Such methods and apparatus are disclosed for example in my U.S. Pat. Nos. 4,836,536 and 4,902,009. With these methods and apparatus, the subject is seated in a generally upright position with his pelvis fixed against movement and the subject's lumbar muscles are exercised by having the subject impose with the lumbar muscles forces against a movement arm to pivot the latter about a horizontal axis against the bias of a resistance preferably one or more dead weights. To increase the efficiency of the exercise as well as the accuracy of measurement of the subject's strength, the weight of the subject's torso is counterweighted since the mass of the torso during testing or exercise of the lumbar extension muscles may produce as little as a few foot-pounds of torque or as much as a hundred foot-pounds of torque or more. However although counterweighting has significantly increased accuracy and efficiency, since in actual practice, the subject's torso pivots about an axis which changes depending on the position of the torso and further since the counterweighting of the torso is calibrated for only one position of the torso prior to the exercise (albeit the position where the weight of the torso would have the most adverse effect on the accuracy of the measurement), the adverse effect of the subject's torso weight on accuracy and efficiency has not been entirely eliminated by counterweighting.

The present invention provides another method and apparatus for exercising the lumbar muscles of the human body while at the same time substantially eliminating the adverse effect of the subject's torso on the efficiency of the exercise and accuracy of the testing of the lumbar muscles.

OBJECTS OF THE PRESENT INVENTION

It is a primary object of the present invention to provide novel method and apparatus for exercising or testing the lumbar muscles of the human body in a highly efficient and accurate manner and which substantially reduces the effect of the subject's torso weight on the accuracy and efficiency of the exercise or test. Included herein are such method and apparatus which will achieve the foregoing object with a very high degree of safety, that is, without subjecting the subject's lumbar muscles to injury from impact or other excessive forces.

Another object of the present invention is to provide such method and apparatus which will achieve the above objects and yet may be utilized in conjunction with methods and apparatus disclosed in my prior United States Patents identified above.

SUMMARY OF INVENTION

In summary, the method and apparatus of the present invention includes the placement of the subject in a generally horizontal position on the subject's side, fixing the subject's pelvis against moment, and having the subject move the back against a movement arm and about a generally vertical axis so that the weight of the subject's torso acts downwardly along a direction generally parallel to the pivotal axis of the movement arm. In this way the weight of the subject's torso will not impose any appreciable movement about the pivotal axis of the movement arm. The movement arm is connected to a resistance preferably a dead weight resistance, to oppose movement of the movement arm in one direction by forces imposed by the lumbar muscles. When the subject relieves pressure against the movement arm while moving in an opposite direction, the resistance weight will return to the starting position and then the excercise is repeated until the subject's lumbar muscles are fatigued and can no longer move the movement arm against the bias of the resistance weight.

In one preferred embodiment of the apparatus of the present invention, a first frame is provided which includes a seat and means for securing the pelvis against movement. In addition a movement arm is pivotally mounted on the frame for movement about a generally horizontal axis when the frame is in an upright position and for movement about a generally vertical axis when the frame has been rotated ninety degrees from the upright position. The frame is pivotally mounted on a stationary support base for movement about a horizontal axis between the upright position and the rotated ninety degree position. The latter position places the subject on his or her side. Resistance to the movement arm is provided by a weight stack preferably a compound weight stack. Means is provided for connecting the movement arm to the weight stack so that the frame when moving to the ninety degree rotated position, moves relative to the weight stack. Other novel features of the invention are described in detail below.

DRAWINGS

Other objects and advantages of the will become apparent from the following more detailed description taken in conjunction with the attached drawings in which.

DETAILED DESCRIPTION

Figure 1:
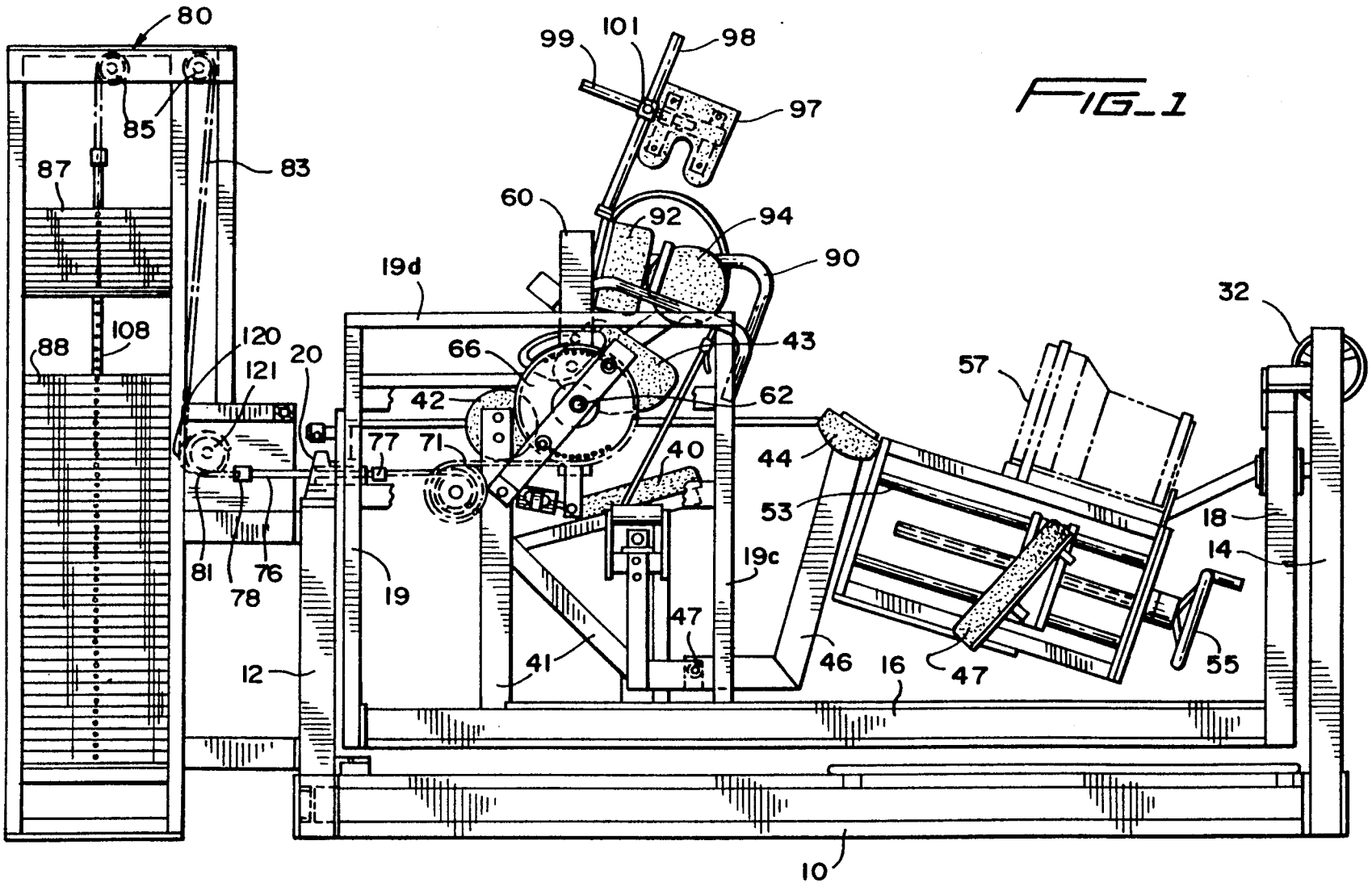
FIG. 1 is an elevational view of apparatus constituting a preferred embodiment of the present invention for exercising and/or testing lumbar muscles.
Figure 2:
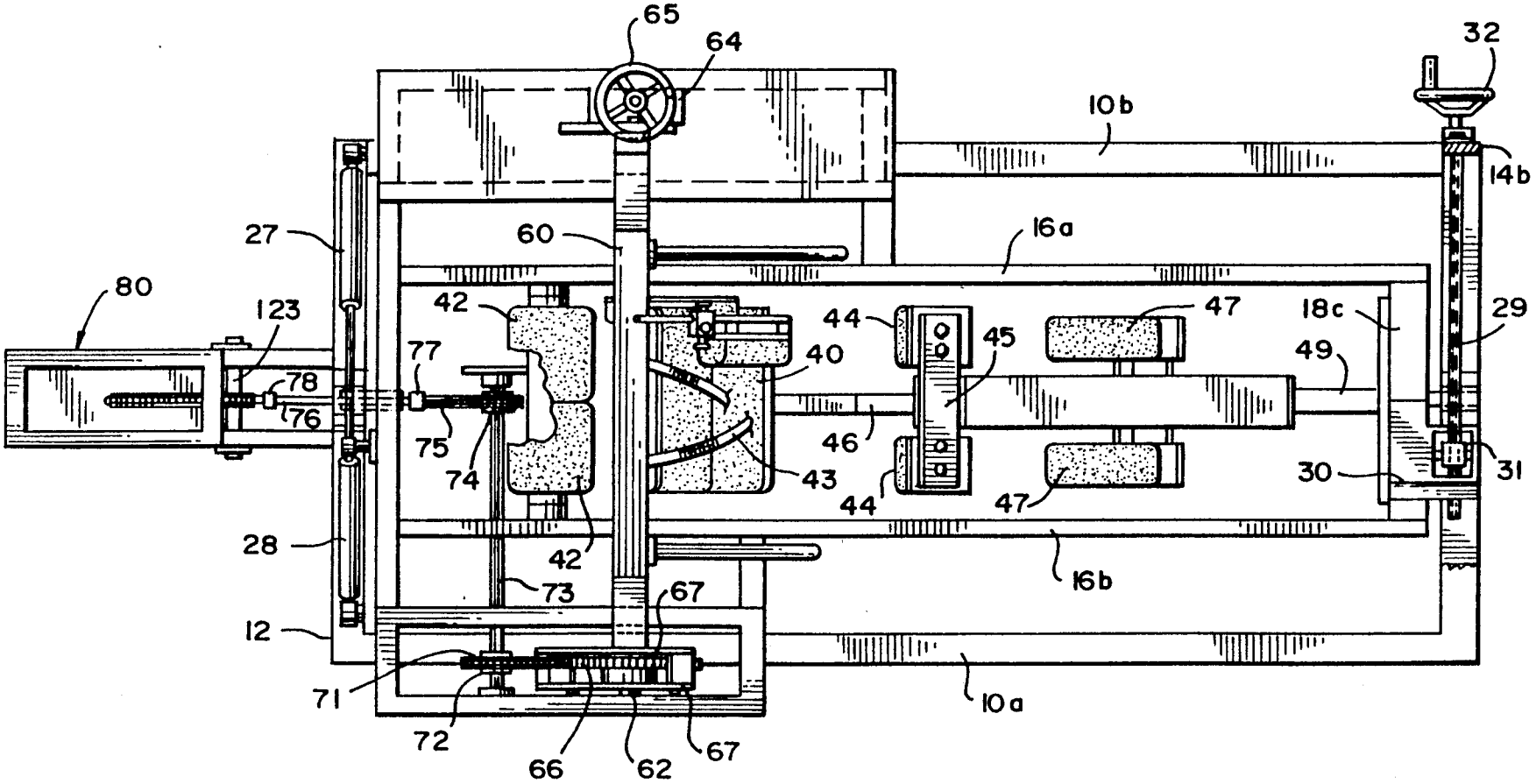
FIG. 2 is a top plan view of the apparatus shown in FIG. 1 and with certain portions removed for clarity.
Figure 4:
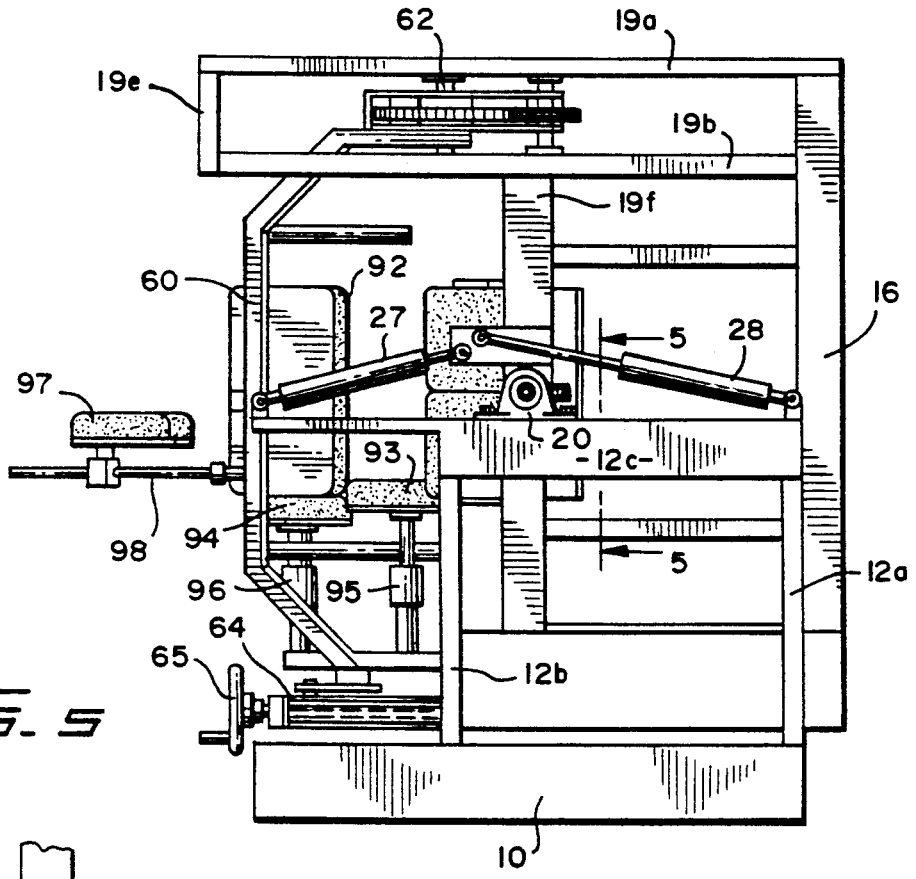
FIG. 4 is a cross sectional view taken generally along lines 4—4 of FIG. 3.
Figure 6:
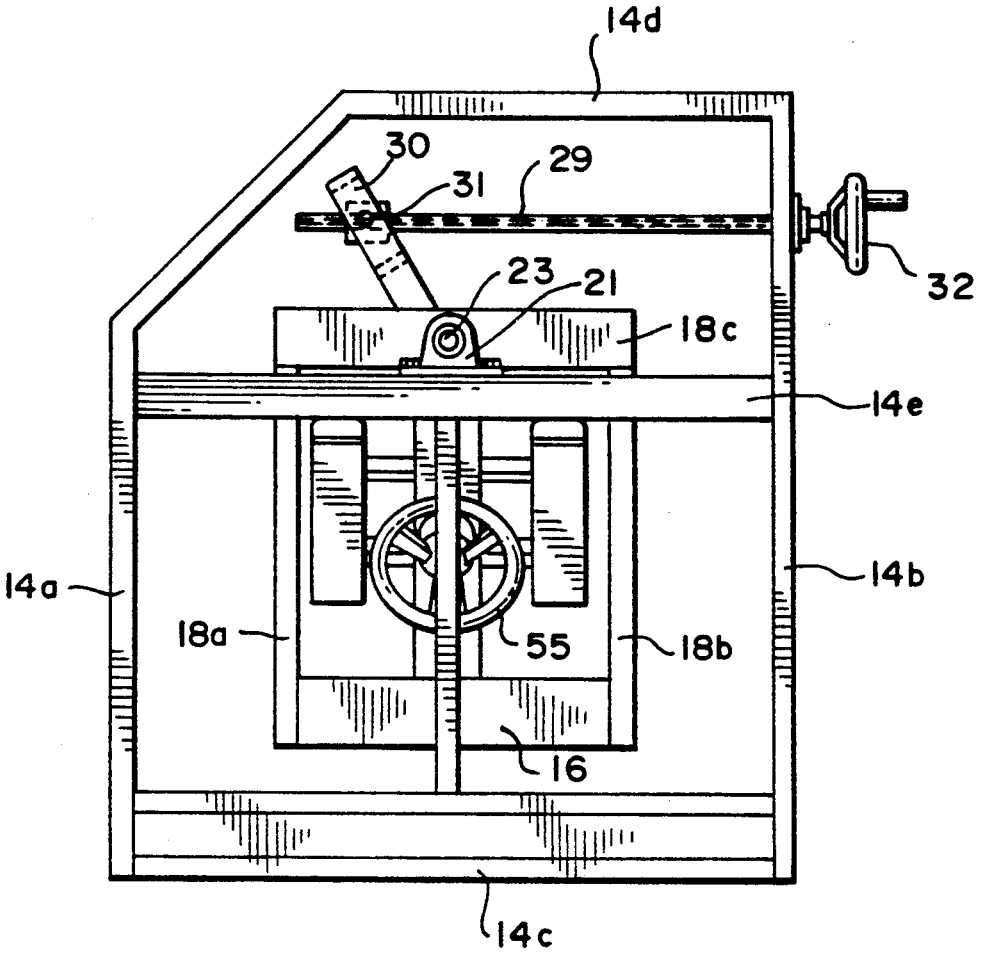
FIG. 6 is an end view of the apparatus taken from the right hand end of FIG. 1 and with certain portions of the apparatus removed for clarity.

Referring now to the drawings in detail there is shown for illustrative purposes only apparatus constituting a preferred embodiment of the present invention for exercising and/or testing the lumbar muscles of the human body. As shown in FIGS. 1 and 2, the apparatus includes a stationary base structure generally designated 10 which in the specific embodiment includes a generally rectangular structural steel construction including opposite side members 10*a* and 10*b* and upstanding end structures 12 and 14 rigidly fixed to the base. FIG. 6 shows one end structure including a cross beam 14*c* at the base and upstanding columns 14*a* and 14*b* joined at the top by cross beam 14*d* and at an intermediate location by cross beam 14*e*. Referring to FIG. 4, the opposite end structure 12 includes upstanding columns 12*a* and 12*b* joined by a cross beam 12*c* all of the base frame members are made from suitable structural steel or steel alloys to provide the necessary support as will become clearer.

Mounted for pivotal movement about a horizontal axis within the base support 10 is a secondary support frame generally designated 16 in FIG. 1 and having a generally rectangular configuration. The specific embodiment includes opposite side beams 16*a* and 16*b* in the base shown in FIG. 2 and opposite end structures generally designated 18 and 19 fixed to and upstanding from the base 16. The right hand end structure 18 as viewed in FIG. 1 includes upstanding columns 18*a* and 18*b* joined by a cross beam 18*c* at the top as best shown in FIG. 6. The movable frame 16 is mounted for horizontal movement relative to the base 10 by shafts 22 and 23 received in journals 20 and 21 fixed to the end structures 12 and 14 of the stationary base, see FIGS. 4, 5 and 6. In the preferred embodiment shown, the movable frame 16 is pivotable or rotatable about the horizontal axis passing through the center of shafts 22 and 23 between a normal position shown in FIG. 1 wherein the columns 18 and 19 extend vertically and a rotated position shown in FIG. 3 where the columns 18 and 19 have rotated 90 degrees so that they extend in a generally horizontal plane for a purpose which will become apparent.

Actuation of the movable frame 16 between the aforementioned positions is achieved in any suitable manner such as in the preferred embodiment which utilizes a rotatable elongated screw 29 journaled for rotation in column 14*b* as best shown in FIG. 6. A nut generally designated 31 is mounted for movement along the screw 29 and connected to an arm 30 which is fixed to the end structure 18 at the top piece 18*c* of the movable frame. Rotation of the screw is achieved by a hand wheel 32. To allow the arm 30 to move along an arc as the movable frame 16 pivots between the positions of FIGS. 1 and 3, a universal bearing is utilized to mount the screw 29 in the column 14*b* of the end structure 14 of the base. Any other suitable actuating means may be employed.

Figure 3:
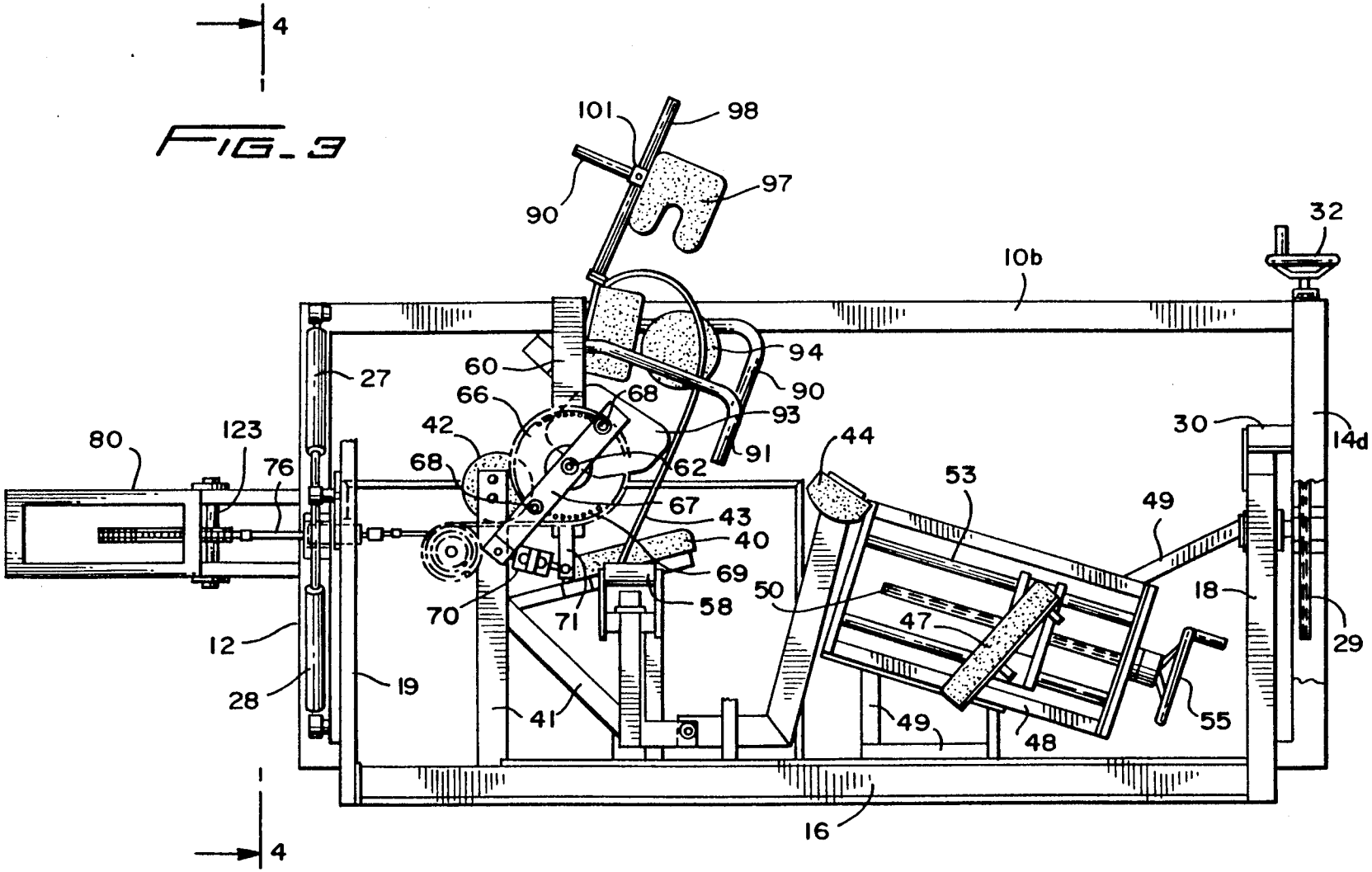
FIG. 3 is a view generally similar to FIG. 2 but with a frame included in the apparatus rotated ninety degrees to one side.

The person whose lumbar muscles are to be exercised or tested is received on a seat 40 fixed to the movable frame 16 by means of support beams 41 best shown in FIG. 1 with the seat 40 extending at a slight incline relative to the horizontal. Just above the rear of seat 40 is a pelvic restraint which in the specific embodiment includes a pair of cylindrical pads 42 mounted between supports 41 so that the pelvis is prevented from moving rearwardly. Movement of the pelvis is prevented by fixing the femurs which of course are connected to the pelvis. The femurs are fixed by means of restraints including a thigh restraint which may be provided by a seat belt 58 to be secured over the thighs of the subject. In addition a femur restraint is provided to engage the tops of the thighs between the seat belt and the knees. In the preferred embodiment, the femur restraint includes pads 44 mounted on an arm 46 which is pivoted by pivot pin 47 for movement about a horizontal axis between an inactive position shown in FIG. 1 and an active position where it engages across the tops of the thighs just above the knees. The legs of the subject when secured are bent at the knees with the feet engaged on inclined foot rests 47 which are mounted to be movable along guide rods 53 into the desired position by means of an elongated screw 50 actuated by a handwheel 55 as shown in FIGS. 1 and 3. Guide rods 53 are mounted in a support frame 48 fixed to the movable frame 16 by support members 49 as best shown in FIG. 3. A video screen 57 is secured on the footrest structure as shown in FIG. 1, the video screen being used to display strength figures and curves during testing and exercise. For a more detailed description of the method and apparatus for securing the pelvis against movement reference may be had to my prior U.S. application Ser. No. 07/361,055 filed Jun. 5, 1989, and identified above.

During exercise, the subject while seated on seat 40 with his pelvis secured against movement exerts a force with his lumbar muscles to pivot a movement arm 60 relative to the movable frame 16 between a rearward position where the spine is in extension and a forward position where the spine is in flexion. Movement arm 60 is mounted for movement about axes provided by shafts 62 which are journaled in the movable frame 16 so that the movement arm is pivotable about the shafts 62, one of the shafts 62 being shown in FIGS. 1 and 4. When the apparatus is shown in the FIG. 1 position, the pivot axes or shafts 62 extend in a generally horizontal plane so that the subject is tested or exercised while sitting on the seat 40 in a generally upright position. During an exercise, the subject exerts with his lumbar muscles a force that is transmitted to the movement arm 60 by means of a resistance pad 92 pivotally mounted on the movement arm 60. The position of the arms of the subject are fixed by means of handle bars 90 and 91 which are fixed to the movement arm 60 to extend forwardly thereof to be conveniently gripped by the subject.

When the subject is being exercised with the moveable frame shown in the upright position of FIG. 1, the weight of the subject's torso is counterbalanced relative to the pivot axis 62 by means of an adjustable counterweight system generally designated 64 located on one side of the movement arm 60 and releasably connected to the movement arm 60. The position of the counterweights are adjusted by means of handwheel 65 as may be required to balance out the subject's torso weight. The counterweight system for reducing the effect of the torso upon the accuracy of the testing, is disclosed in my prior U.S. Pat. Nos. 4,836,536 and 4,902,009 identified above as is the method of testing and/or exercising when in the upright position.

In the rotated position of the movable frame 16 shown in FIG. 3, the pivot axis 62 of the movement arm 60 extend in a generally vertical plane. In order to support the torso of the subject when in the rotated or lateral position, support pads 93 and 94 are fixed to the movement arm by means of posts 95 and 96 shown in FIG. 4 and which are adjustable to position the pads 93 and 94 to suit a particular subject. In addition a head support pad 97 is provided to engage and position the side of the subject's head when in the rotated position. Support pad 97 is secured to a rod 99 which is adjustably received in a block 101 which in turn is slidable along a second rod 98 into a desired adjusted position. Rod 98 is secured to the movement arm 60. By this mounting, head pad 97 may be adjusted in different angular planes as well as forwardly or rearwardly or upwardly or downwardly to suit the physical characteristics of the particular subject being exercised. The subject is further secured by shoulder straps 43 secured at one end to the movement arm 60 and at the other end to the support structure below the seat 40.

During an exercise, the subject moves the movement arm 60 rearwardly in extension against a resistance which preferably is provided by one or more dead weights. In the preferred embodiment shown, a compound weight stack generally designated 80 in FIG. 1 is provided. In the specific embodiment shown, the compound weight stack includes independent sets of weights 87 and 88 selectively connectable to a vertical rod 108. For a detailed description of the compound weight stack per se, reference may be had to my prior U.S. Pat. No. 4,834,365 identified above. The resistance weights are connectable to the movement arm 60 for purposes of exercising the lumbar muscles by means of a sprocket 66 mounted about the pivot shaft 62 for rotation. A pair of keeper plates 67 are mounted about the shaft 62 on opposite sides of the sprocket 66 for receiving locking pins 68 which are insertable in one of several angularly spaced apertures 69 formed about the peripheral areas of the sprocket 66 as best shown in FIGS. 1 and 3. The keeper plates 67 are fixed to each other and connected to the movement arm 60 by means of a strain gauge designated 70 in FIG. 3. When the pins 68 are received in an aperture 69 in the sprocket 66, the resistance weights will be connected to the movement arm 60 such that when the movement arm is pivoted in one direction by the lumbar muscles, one or more resistance weights will be raised and when the movement arm is pivoted in the opposite direction the weights will descend to their original position. For a more detailed description of the sprocket and keeper assembly, reference may be had to my U.S. Pat. No. 4,902,009 identified above.

Figure 5:
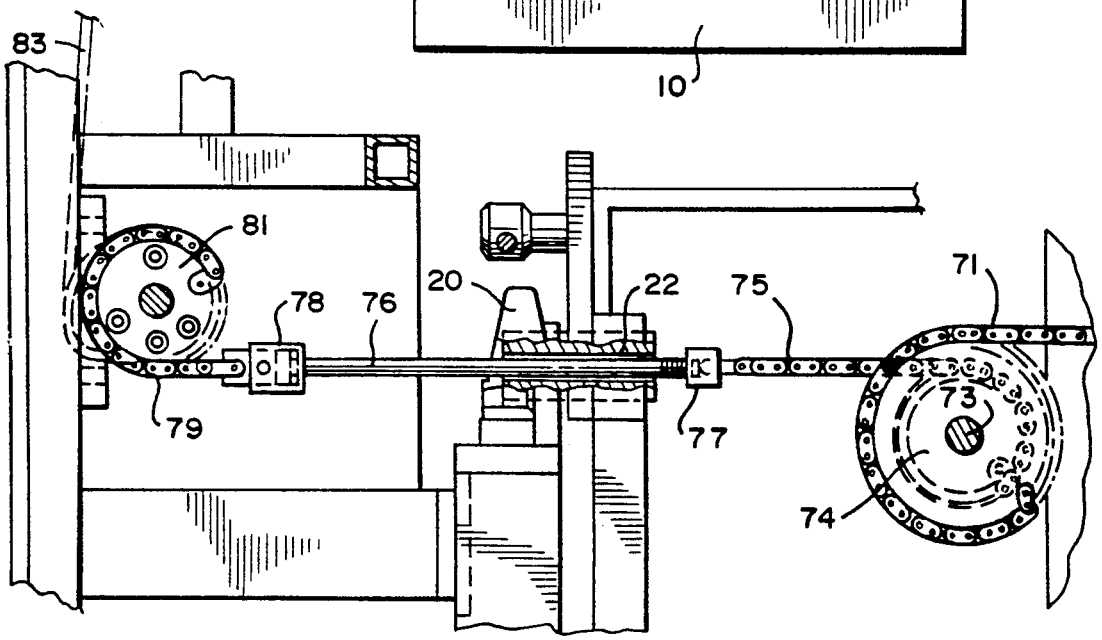
FIG. 5 is a cross sectional view taken generally along lines 5—5 of FIG. 4.

In order to connect the sprocket 66 to the weight stack, a first cable or chain 71 is fixed to the periphery of the sprocket 66 and extends horizontally to a second sprocket 72 which is mounted to a horizontal shaft 73 which extends transversely of the frame structure as best shown in FIGS. 1, 2 and 5. On the inner portion of shaft 73 is another sprocket 74 about which a second cable or chain 75 is trained to extend in a generally horizontal plane rearwardly where it is connected by a thrust bearing generally designated 77 to a rod 76. The latter passes through a hollow passage formed in shaft 22 which serves to mount the movement arm 60 relative to the movable frame 16 as described above. Outwardly of the end structure 12 of the stationary base 10, rod 76 is connected by another thrust bearing 78 to a cable or chain 81 which is connected via a cam 120 to a vertical chain 83 (FIG. 1) trained about sprockets 85 at the upper end of the weight stack 80 and connected to the vertical weight stack rod 108. Cable 81 is fixed to pulley 121 (FIG. 1) mounted on a shaft 123 shown in FIG. 2. Cam 120 is mounted on shaft 123 and receives chain 83.

Figure 7:
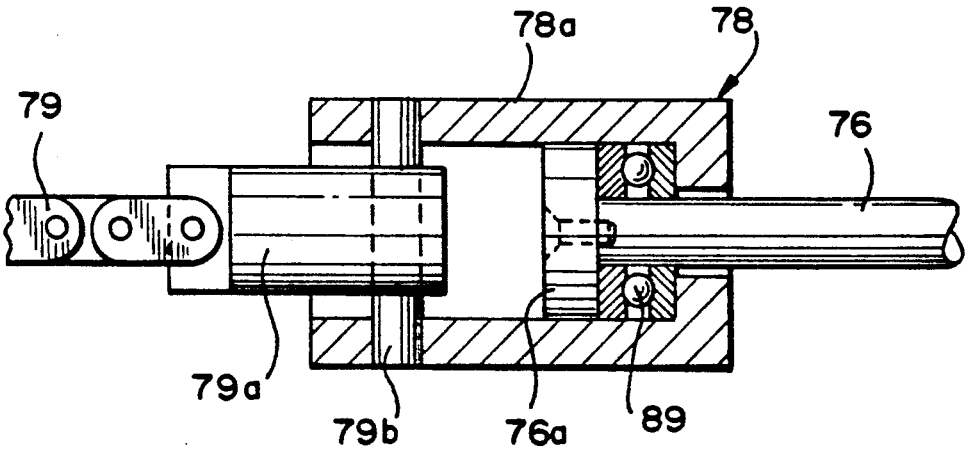
FIG. 7 is a fragmental detail view of a thrust bearing included in a connecting rod included in the apparatus.

In the preferred embodiment shown in FIG. 7, the thrust bearing 78 includes a hollow housing **78*a* through one end wall of which extends the rod 76 which is provided with a head 76*a*. A ball bearing 89 is provided between rod head 76*a* and the end wall of the housing 78. Through the other end of the housing 78 extends a small rod 79*a* connected to the chain 79 which leads to the weight stack. Rod 79*a* is pinned by a cross pin 79*b* to the housing 78*a*. It will be seen that upon rotation of the sprocket 66 to move the movement arm in a rearward direction, the head 76*a* of the rod 76 will pull the chain 79 through the connection between the housing 78*a* and the rod 79*a* to thereby transmit a force to lift the resistance weights. At the same time the thrust bearings will permit the moveable frame to be pivoted between the positions shown in FIGS. 1 and 3**.

In order to dampen the movement of the movable frame 16 relative to the base when moving between the upright position shown in FIG. 1 and the rotated position shown in FIG. 3, it is preferred that hydraulic or other fluid cylinders be connected between the movable frame 16 and the base 10. In the preferred embodiment, a pair of hydraulic cylinders 27 and 28 are connected between the stationary end structure 12 of the base 10 and the end structure 19 of the movable frame 16 as best shown in FIGS. 3 and 4.

To summarize use of the method and apparatus of the present invention, a subject may be tested and exercised with the movable frame in the upright position shown in FIG. 1. In this mode the torso weight of the subject is counterweighted by use of the counterweight assembly 64 as disclosed in my prior U.S. Pat. No. 4,902,009 identified above. The testing and exercise may proceed as disclosed in my prior U.S. Pat. No. 4,902,009 identified above.

However when it is desired to obtain an even more precise measurement of the strength of the lumbar muscles, the subject is tested with the movable frame rotated into the position of FIG. 3. In this position, the pivot axis of the movement arm 60 extends in a vertical plane generally parallel to the axes about which the spine will pivot during the exercise of the lumbar muscles. Since the axes are generally parallel to each other, the torso weight should not produce any significant torque that would effect accuracy of the measurement or efficiency of the exercise. In practicing this mode, the subject is secured on the seat 40 with the pelvis secured against movement, when the movable frame is in the upright position shown in FIG. 1. The head and torso pads 93 and 94 are adjusted to the subject's characteristics while the movable frame is in the upright position. The movable frame is then rotated into the position of FIG. 3 during which the side of the torso and the head are supported by pads 93, 94 and 97. While positioned on his/her side the subject exerts forces with the lumbar muscles to pivot the movement arm 60 about its pivot axis which now extends vertically and generally parallel to the axes about which the spine pivots during rotation. The fact that the pivotal axis of the spine changes depending upon the position of the subject's spine will be of no significant consequence since the weight of the subject's torso will still be acting downwardly without any appreciable moment about the axis of the movement arm. The subject is now in position to proceed with the exercise of the lumbar muscles.

Due to the passage of the sprocket rod 76 through the hollow pivot shaft 22 of the movable frame, it is not necessary to disconnect the weight stack 80 from the sprocket 66 during rotation of the movable frame between the positions of FIGS. 1 and 3.

What is claimed is:

1. Apparatus for exercising the lumbar muscles comprising in combination, support means for supporting a person on his or her side in a generally horizontal plane for movement of the person's spine about a generally vertical axis in response to forces generated by the lumbar muscles, means for securing the pelvis of the person against movement, resistance means opposing movement of the spine in one direction about said axis, a stationary support and means for pivotally mounting said support means to the stationary support for movement between a first position wherein the person is supported on his/her side for movement of the spine about a generally horizontal axis, and wherein said resistance means includes a movement are engageable by the person's back and a backrest pivotally mounted on the movement arm and engageable by the person's back above the lumbar muscles.

2. Apparatus defined claim 1 wherein said resistance means includes a freely moveable dead weight.

3. Apparatus defined in claim 1 further including means for fixing the position of the person's head relative to the movement arm.

4. Apparatus defined in claim 3 including means for fixing the position of the person's arms relative to the movement arm.

5. Apparatus defined in claim 1 including support means engageable with the side of the person's head and torso.

6. Apparatus defined in claim 1 wherein said resistance means includes a wight stack and means for connecting at least one weight in the stack to the movement arm.

7. Apparatus defined in claim 1 including means for pivotally mounting said support means to the stationary support for movement about a pivotal axis between a first position wherein the person is supported on his/her side and a second position wherein the person is supported in upright position and wherein said resistance means is connected to said movement arm by a connecting member extending along an axis coinciding with the pivotal axis of the support means.

8. Apparatus defined in claim 1 including head support means for supporting the person's head.

9. Apparatus defined in claim 1 including torso support means for supporting one side of the person's torso.

10. Apparatus for exercising the lumbar muscles comprising in combination, support means for supporting a person on his or her side in a generally horizontal plane for movement of the person's spine about a generally vertical axis in response to forces generated by the lumbar muscles, a movement arm mounted on the support means for movement about a vertical axis in response to forces imposed by the lumbar muscles, said movement are being positioned to be engageable by the back of the person, resistance means connected to said movement arm opposing movement of the spine in one direction about said axis, a primary support, and means mounting the support means on the primary support for rotation about an axis between a first position wherein the movement arm is movable about a horizontal axis and a second position wherein the movement arm is movable about a vertical axis.

11. Apparatus defined in claim 10 wherein said resistance means is connected to the movement arm by a connecting member having an axis coinciding with the rotational axis of the support means.

12. Apparatus defined in claim 11 wherein said resistance means includes a weight stack.

13. Apparatus defined in claim 12 wherein said weight stack includes a cable and there is further included means including a thrust bearing connecting the cable and said connecting member.

14. Apparatus defined in claim 10 further including means for fixing the position of the persons head relative to the movement arm during movement of the movement arm.

15. Apparatus defined in claim 10 wherein said resistance means includes a back rest pivotally mounted on the movement arm and engageable by the persons back.

16. Apparatus defined in claim 14 wherein said resistance means includes a back rest pivotally mounted on the movement arm and engageable by the persons back.

17. Apparatus for exercising the lumbar muscles comprising in combination, support mean for supporting a person on his or her side in a generally horizontal plane for movement of the person's spine about a generally vertical axis in response to forces generated by the lumbar muscles, means for securing the pelvis of the person against movement, resistance means opposing movement of the pine in one direction about said axis, a stationary support and means for pivotally mounting said support means to the stationary support for movement between a first position wherein the person is supported on his/her side for movement of the spine about said vertical axis and a second position wherein the person is supported in upright position for movement of the spine about a generally horizontal axis, and wherein said resistance means includes a movement arm engageable by the person's back, and wherein there is further included head support means on the movement arm for supporting the head of the person.

* * * * *

UNITED STATES PATENT AND TRADEMARK OFFICE

CERTIFICATE OF CORRECTION

PATENT NO. : 5,171,200

DATED : December 15, 1992

INVENTOR(S) : ARTHUR A. JONES

It is certified that error appears in the above-identified patent and that said Letters Patent is hereby corrected as shown below:

Column 7, line 25, after "about" insert -- said vertical axis and a second position wherein the person is supported in upright position for movement of the spine about --.

Signed and Sealed this

Twenty-sixth Day of October, 1993

*Attest:*

*Attesting Officer*

BRUCE LEHMAN

*Commissioner of Patents and Trademarks*